US008974250B2

(12) United States Patent
Pao et al.

(10) Patent No.: US 8,974,250 B2
(45) Date of Patent: Mar. 10, 2015

(54) COUPLING TERMINAL STRUCTURE AND ELECTRICAL CONNECTOR USING THE SAME

(71) Applicant: Chief Land Electronic Co., Ltd., New Taipei (TW)

(72) Inventors: Chung-Nan Pao, New Taipei (TW); Yu-Hsiung Lin, Pingtung County (TW); Sheng-Hsiang Huang, New Taipei (TW); Yu-Feng Ke, Taoyuan County (TW)

(73) Assignee: Chief Land Electronic Co., Ltd., New Taipei (TW)

( * ) Notice: Subject to any disclaimer, the term of this patent is extended or adjusted under 35 U.S.C. 154(b) by 77 days.

(21) Appl. No.: 13/826,869

(22) Filed: Mar. 14, 2013

(65) Prior Publication Data

US 2014/0273651 A1 Sep. 18, 2014

(51) Int. Cl.
*H01R 24/00* (2011.01)
*H01R 13/6461* (2011.01)

(52) U.S. Cl.
CPC ..... *H01R 13/6461* (2013.01)
USPC ..... 439/660; 439/79

(58) Field of Classification Search
CPC ..... H01R 13/04; H01R 13/65802; H01R 23/005; H01R 23/688; H01R 23/7073
USPC ..... 439/79, 108, 607.05–607.07, 439/607.11–607.13, 607.17, 607.18, 607.1, 439/660, 884, 941
See application file for complete search history.

(56) References Cited

U.S. PATENT DOCUMENTS

| | | | | |
|---|---|---|---|---|
| 5,199,886 | A * | 4/1993 | Patterson | 439/79 |
| 6,106,308 | A * | 8/2000 | Chen et al. | 439/79 |
| 6,123,586 | A * | 9/2000 | MacDougall | 439/701 |
| 6,776,649 | B2 * | 8/2004 | Pape et al. | 439/485 |
| 7,473,108 | B2 * | 1/2009 | Lappohn | 439/79 |
| 7,963,806 | B1 * | 6/2011 | Scott Kline et al. | 439/660 |
| 8,187,017 | B2 * | 5/2012 | Daily et al. | 439/290 |
| 8,202,120 | B2 * | 6/2012 | Ko | 439/607.35 |
| 8,292,673 | B2 * | 10/2012 | Zhu | 439/660 |
| 8,517,774 | B2 * | 8/2013 | Kumamoto et al. | 439/660 |
| 8,523,615 | B2 * | 9/2013 | Luo et al. | 439/660 |
| 8,622,771 | B2 * | 1/2014 | Pan | 439/660 |
| 8,771,016 | B2 * | 7/2014 | Atkinson et al. | 439/607.07 |

* cited by examiner

*Primary Examiner* — Thanh Tam Le
(74) *Attorney, Agent, or Firm* — Li & Cai Intellectual Property (USA) Office

(57) ABSTRACT

The present invention discloses a coupling terminal structure and electrical connector using the same. The coupling terminal structure comprises: at least a pair of first terminal and second terminal, wherein the first terminal includes a first contact portion, a first neck portion and a first extension portion, the second terminal includes a second contact portion, a second neck portion and a second extension portion. The first contact portion is disposed aside to the second contact portion at a first distance, while the first extension portion is disposed aside to the second extension portion at a second distance. The first distance is greater than the second distance, thereby forming an electromagnetic coupling effect between the first extension portion and the second extension portion to provide better shielding and decrease interference between and within terminals.

18 Claims, 8 Drawing Sheets

COUPLING TERMINAL STRUCTURE AND ELECTRICAL CONNECTOR USING THE SAME

BACKGROUND OF THE INVENTION

1. Field of the Invention

The present invention relates to a coupling terminal structure and an electrical connector using the same; in particular, to a coupling terminal structure and an electrical connector which can provide electromagnetic coupling effect by structural properties of the terminals to reduce crosstalk interference.

2. Description of Related Art

FIG. 1 shows a conventional coupling terminal of an electrical connector. The first terminal 1 and the second terminal 2 have overall similar form and structure, and are generally parallel from end to end. For example, assume that a cutting line cuts the first terminal 1 and the second terminal 2, which are arranged side by side, near their left ends at two first cutting points (11, 21). P is defined as the distance between the two first cutting points (11, 21). Similarly, assume that a cutting line cuts the first terminal 1 and the second terminal 2 near their midsections of the two terminals at two second cutting points (12, 22). The distance between the two second cutting points (12, 22) is essentially equal to P. Described above is the conventional practice and structural arrangement of conventional coupling terminals.

However, crosstalk is a persisting problem between neighboring terminals or within a terminal itself, especially when the electrical connector is used for transmitting data at high speed (e.g. 3 Gbps). In order to transmit a large amount of information in a short amount of time, the signals need to be transmitted at high bandwidths. Therefore, the frequency of the signals needs to be higher, possibly between 3 Ghz and 5 Ghz or higher. Higher signal frequencies increase crosstalk, which affect the integrity of data transmission and raise chances for bit error.

Therefore if proper shielding cannot be provided to reduce crosstalk, signal frequency must be reduced which leads to bottlenecking of data transmission and reduction of data transmission frequency. Even if proper shielding can be provided between neighboring terminals, an increase in shielding units and grounding units increases the volume and weight of electrical connectors, which contradicts the current trend of miniaturization of electronic elements and unnecessarily increases production cost.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a coupling terminal structure of an electrical connector for improving the problem of crosstalk between terminals, in order to increase the quality of data transmission.

In order to achieve the aforementioned objects, the present disclosure provides a coupling terminal structure of an electrical connector, which mutually creates electromagnetic coupling effect when transmitting data signals so as to reduce crosstalk through non-grounding shielding structures. The coupling terminal structure includes: a plurality of first terminals and second terminals in pairs, mutually arranged side by side and grouped to form a three-dimensional terminal network. The first terminal includes a first contact portion, a first neck portion and a first extension portion. The second terminal includes a second contact portion corresponding to the first contact portion, a second neck portion corresponding to the first neck portion and a second extension portion corresponding to the first extension portion. The first contact portion and the second contact portion are arranged with a first distance therebetween. The first extension portion and the second extension portion are arranged with a second distance therebetween. The first distance is larger than the second distance. A wide surface of the first extension portion orients toward a wide surface of the second extension portion. By this configuration, electromagnetic coupling effect is created between the first extension portion and the second extension portion.

In order to achieve the aforementioned objects, the present disclosure provides an electrical connector including the mentioned coupling terminal structure. The electrical connector includes a dielectric housing with the terminal network disposed therein. The dielectric housing fixes the first terminals and the second terminals of the terminal network in place, and consequently fixes the first distance and the second distance. The first contact portion and the second contact portion form an electrical-connection interface on any face of the electrical connector.

In summary, in regards to the principle technical features of the present disclosure, the first distance between the first contact portion and the second contact portion is larger than the second distance between the extension portion and the second extension portion, and the first wide face orients toward the second wide face. In other words, the preferable electromagnetic coupling effect is generated due to the mutually facing wide faces, which are formed in relative proximity, of the first extension portion and second extension portion. As a result, the transmitted signal is better coated, interference to and from foreign objects is reduced, and signal transmission quality of the electrical connector is effectively increased.

In order to further the understanding regarding the present invention, the following embodiments are provided along with illustrations to facilitate the disclosure of the present invention without limiting the same.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1:
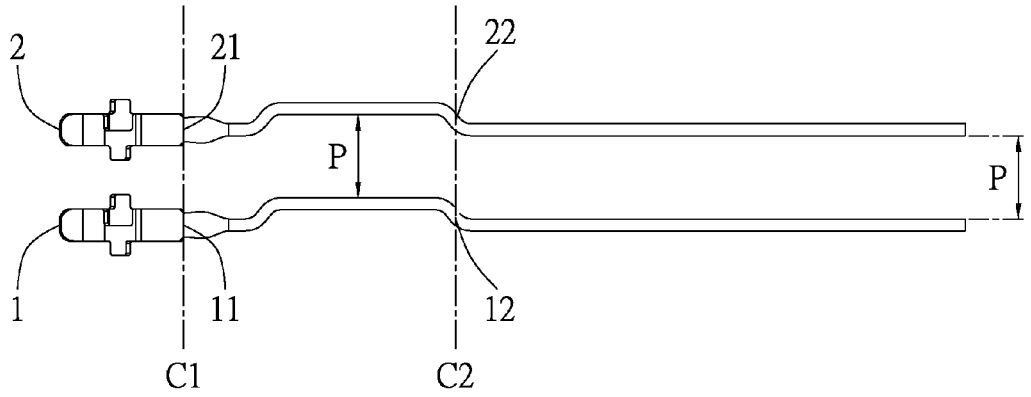
FIG.1 PRIOR ART
FIG. 1 shows a schematic diagram of a conventional connector terminal.
Figure 2:
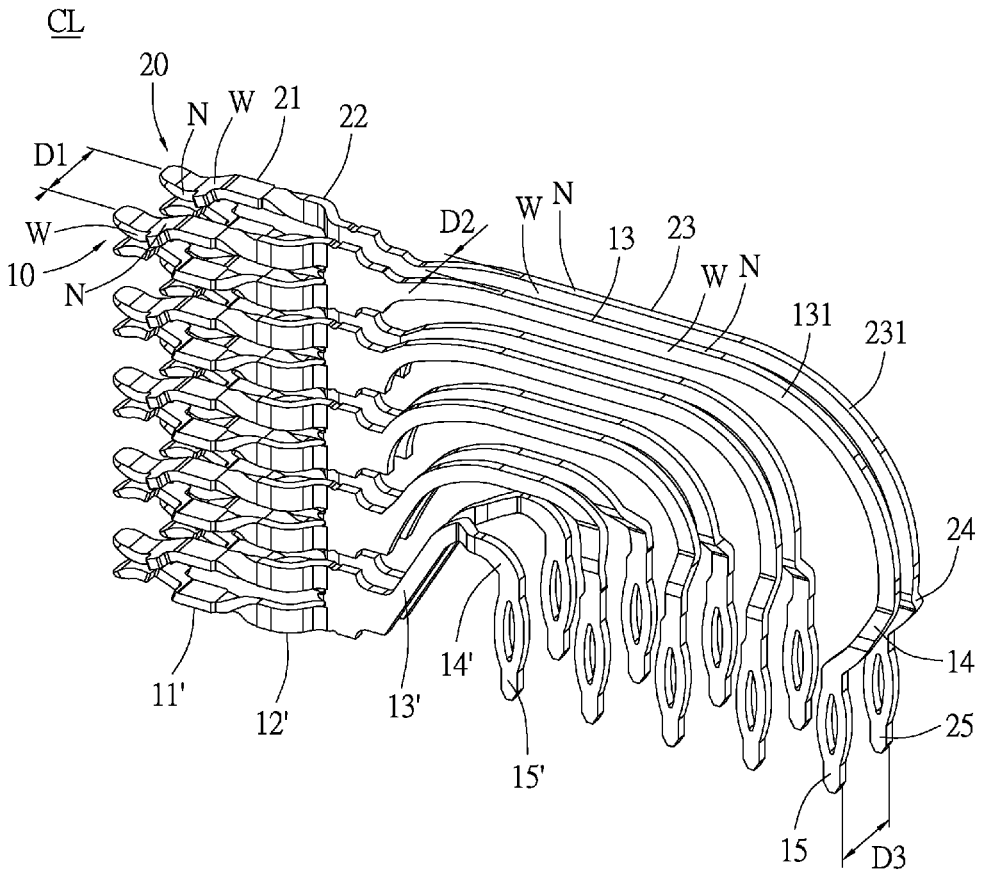
FIG. 2 shows a perspective diagram of a coupling terminal structure of an electrical connector of the present disclosure.
Figure 3:
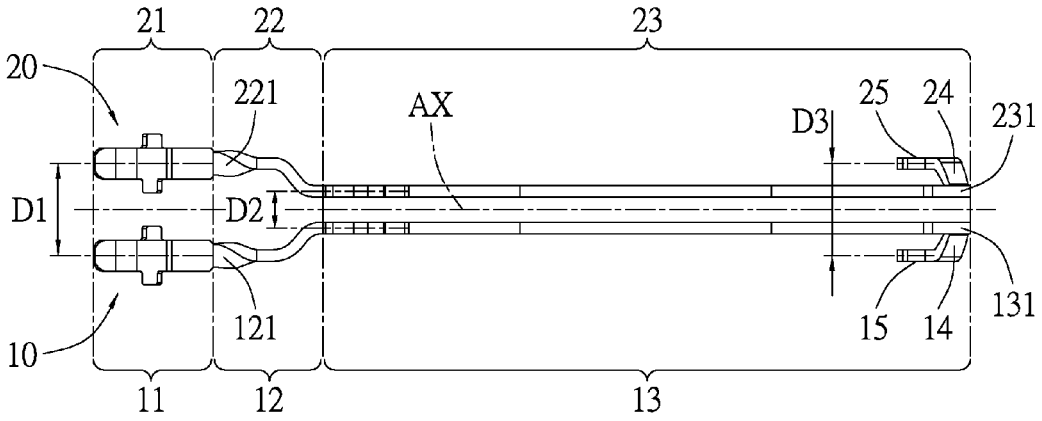
FIG. 3 shows a top view of a first terminal and a second terminal of a coupling terminal of an electrical connector of the present disclosure.
Figure 4:
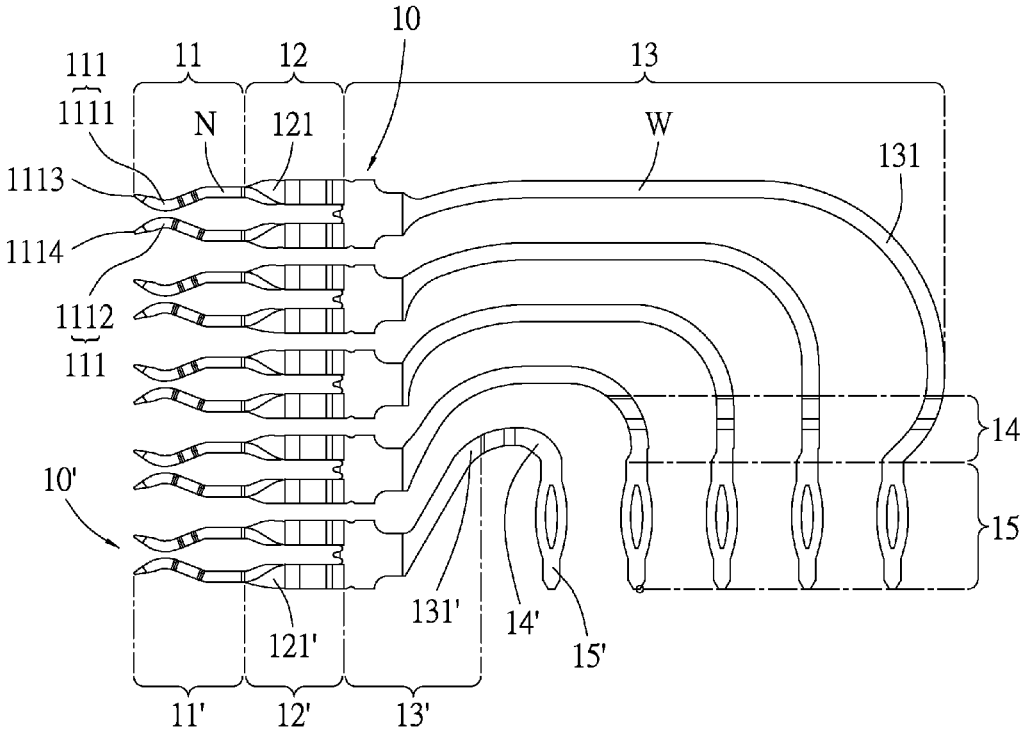
FIG. 4 shows a side view of a coupling terminal of an electrical connector of the present disclosure.

Referring to FIG. 2, FIG. 3, and FIG. 4, in order to improve the problem of crosstalk between terminals or within a terminal, the present disclosure provides a coupling terminal structure of an electrical connector which mutually creates electromagnetic coupling effect when transmitting data signals so as to reduce crosstalk through non-grounding shielding structures. For example, the two top-most terminals include a plurality of the first terminals 10 and the second terminals 20 in pairs, mutually arranged side by side and grouped to form a three-dimensional terminal network CL. FIG. 2 shows a 2×5 terminal network CL, but the present disclosure is not limited thereto. The terminal network CL can also be 2×5, 6×5, 4×8, etc. the first terminal 10 and the second terminal 20 can be electrical terminals of any type, such as: single-ended signal terminals, differential signal terminals, or ground terminals. A pair of differential signal terminals is an ideal example for further explanation. The first terminal 10 and the second terminal 20 can be respectively a positive differential signal terminal and a negative differential signal terminal.

Structurally, the first terminal sequentially includes a first contact portion 11, a first neck portion 12 and a first extension portion 13. The second terminal 20 sequentially includes a second contact portion 21 corresponding to the first contact portion 11, a second neck portion 22 corresponding to the first neck portion 12, and a second extension portion 23 corresponding to the first extension portion 13. A first distance D1 is the distance between the contact portion 11 and the second contact portion 21. A second distance D2 is the distance between the first extension portion 13 and the second extension portion 23. The first distance D1 is larger than the second distance D2. The first extension portion 13 and the second extension portion 23 are respectively a strip shaped conducting body with a wide surface (FIG. 2, label omitted) and a narrow surface (FIG. 2, label omitted). Ideally the wide surface of the first extension portion 13 orients toward the wide surface of the second extension portion 23, for enhancing the electromagnetic coupling effect.

Therefore, in order to improve crosstalk between terminals, the structure of the terminals of the present disclosure require that the first distance D1 between the first contact portion 11 and the second contact portion 12 be larger than the second distance D2 between the first extension portion 13 and the second extension portion 23. Taking the first terminal 10 for example, as long as the above feature is complied, then the first neck portion 12 connecting the first contact portion 11 and the first extension portion 13 does not need to connect the first contact portion 11 and the first extension portion 13 by any definite method or structure. Likewise, the same applies to the second neck portion 22.

As shown in top view of FIG. 3, the first terminal 10 and the second terminal 20 exhibit reflective symmetry about plane AX. Analogously, other terminals beside the first terminal 10 and the second terminal 20 in FIG. 2 or FIG. 4 likewise exhibit reflective symmetry. However, the present disclosure is not limited to such structure with reflective symmetry. As shown in FIG. 3, starting from the first contact portion 11, the first neck portion 12 bends inwardly toward the plane of symmetry AX and connects to the first extension portion 13. The second neck portion 22 corresponding to the first neck portion 12 also bends inwardly toward the plane of symmetry AX, and then extends to the second extension portion 23. Therefore, in order for the first distance D1 to be larger than the second distance D2, during manufacturing of terminals, a midsection of a terminal is press worked to respectively form a first neck portion 12 and a second neck portion 22 by bending one terminal towards the other terminal or bending the two terminals toward the plane of symmetry AX, such that the second distance D2 between the first extension portion 13 and the second extension portion 23 respectively behind the first neck portion 12 and the second neck portion 22 is consequently smaller than the first distance D1.

Ideally, the ratio of the first distance D1 to second distance D2 ratio is between 40:7 (ratio of 5.714) and 40:15 (ratio of 2.667). In a more precise embodiment, the first distance D1 can be 2 millimeters, and the second distance D2 can be 0.55 millimeters.

Additionally, in order to be compatible with structural specifications of dielectric housings of conventional electrical connectors, the first contact portion 11 can be parallel with or symmetrical to the second contact portion 21. Referring to FIG. 4, the first contact portion can further include a first gripping portion 111. The first gripping portion 111 further includes a top gripping arm 1111 and a bottom gripping arm 1112 each having an arc shape such that the distance between them is smaller than the distance between them when an arc shape is absent. A minimum distance is formed between the top and bottom gripping arms 1111 and 1112 to provide a better gripping effect. Due to the arc shape, the tips of the top and bottom gripping arms 1111 and 1112 respectively form a top curled tip 1113 and a bottom curled tip 1114. As a result, a relatively widest opening is formed between the top gripping arm 1111 and the bottom gripping arm 1112 from the top curled tip 1113 to the bottom curled tip 1114. When mating with a male plug, the wide-to-narrow structure can provide a mating guide, facilitating the plugging of a male plug (not shown in the figure). Similarly, the second terminal 20 has a second gripping portion similar in structure to the first gripping portion 111 (refer to FIG. 2, label omitted).

As shown in FIG. 2, FIG. 3 and FIG. 4, taking the first terminal 10 for example, the first neck portion 12 includes a first twist portion 121 proximal to the first contact portion 11. The wide surface W of the first extension portion 13 faces sideways, and the narrow surface (not labeled) faces downwards (FIG. 4). However, in order for the first contact portion 11 to form the abovementioned structure favorable for mating with male plugs, the first twist portion 121 is used so that the first contact portion 11 can rotate about its longitudinal direction such that the narrow surface (N) can face sideways and the wide surface (not labeled) can face upward or downward.

Ideally, the first terminal 10 extends from the first extension portion 13 to form a third neck portion 14 and a third contact portion 15. In other words, the first contact portion 11 and the third contact portion 15 are respectively positioned at two ends of the first terminal.

Similarly, the second terminal 20 extends from the second extension portion 23 to form a fourth neck portion 24 corresponding to the third neck portion 14 and a fourth contact portion 25 corresponding to the third contact portion 15. In the present embodiment the third contact portion 15 and the fourth contact portion 25 are both pins with tear-drop shaped apertures, but the present disclosure is not limited to the same. The third contact portion 15 and the fourth contact portion 25 are respectively the other end portions of the first terminal 10 and the second terminal 20 in the present disclosure, and can be electrical contacts, pins, male or female plugs of any specification or form. However, most importantly, a third distance D3 between the third contact portion 15 and the fourth contact portion 25 is necessarily larger than the second distance D2. The relative size of the third distance D3 to the first distance D1 is not limited, but is preferably equal to the first distance D1. The individual and relative structures of the third neck portion 14 and the fourth neck portion 24 are similar to that of the first neck portion 12 and the second neck portion 22, and are not further detailed herein.

Ideally, the present disclosure is embodied by a right angle adapter of an electrical connector. The first extension portion 13 can further have a first curved portion 131, the first curved portion 131 is usually a curve having a substantially right angle. As shown in FIG. 4, the curve bends downward, but is not limited to such configuration, and can also bend upward out of or into the page of FIG. 4. The angle of the curve is likewise not limited herein. Referring back to FIG. 4, the first curved portion 131 can guide the orientation of the third contact portion 15 for guiding the orientations of the third contact portion 15 and the first contact portion 11 to be perpendicular. The second extension portion further has a second curved portion 231 corresponding to the first curved portion 131. The second curved portion 231 guides the fourth contact portion 25 to be perpendicular to the second contact portion 21. However, regardless of how the first curved portion 131 and the second curved portion 231 are bended, resulting the third distance D3 must be smaller than the second distance D2 in order to comply with the conditions above.

As a side note, the first distance D1, the second distance D2 and the third distance D3 are defined as: taking the first distance D1 for example, the distance is defined as the distance between the central axes (as shown in FIG. 3, label omitted) of the first contact portion 11 and the second contact portion 21. The second distance D2 and the third distance D3 are similarly defined.

However, the first curved portion 131 may be unnecessary when not used on right angle adapters. Taking for example the first terminal 10' on the bottom of FIG. 2 and FIG. 4, the third neck portion 14' directly extends downward from the first extension portion 13' such that the third contact portion 15' ultimately faces downward. The first curved portion 131' exists but is not very conspicuous.

Figure 5:
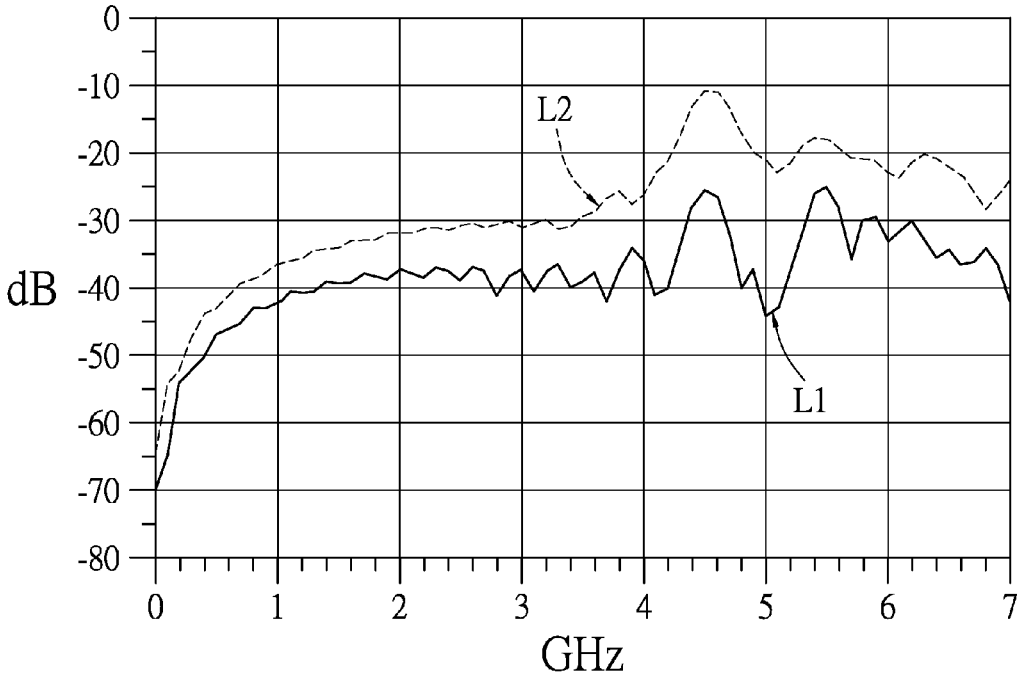
FIG. 5 shows a graph of crosstalk under varying frequencies of a coupling terminal of an electrical connector of the present disclosure and a conventional terminal.

Referring to FIG. 5, the present disclosure can effectively reduce crosstalk between or within terminals by the above-mentioned technical features. The vertical axis of FIG. 5 is the noise value in decibels (dB). The horizontal axis is the signal frequency in gigahertz (GHz). The first curve L1 is the noise level of crosstalk when the coupling terminal structure of the electrical connector of the present disclosure transmits signal at various frequencies. The first curve L2 is the noise level of crosstalk when a conventional coupling terminal structure transmits signal at various frequencies. It can be seen from FIG. 5 that transmitting signal with the present disclosure creates less crosstalk than the conventional terminal does. Therefore, the present disclosure indeed effectively reduces crosstalk and increases the signal to noise ratio.

Figure 6:
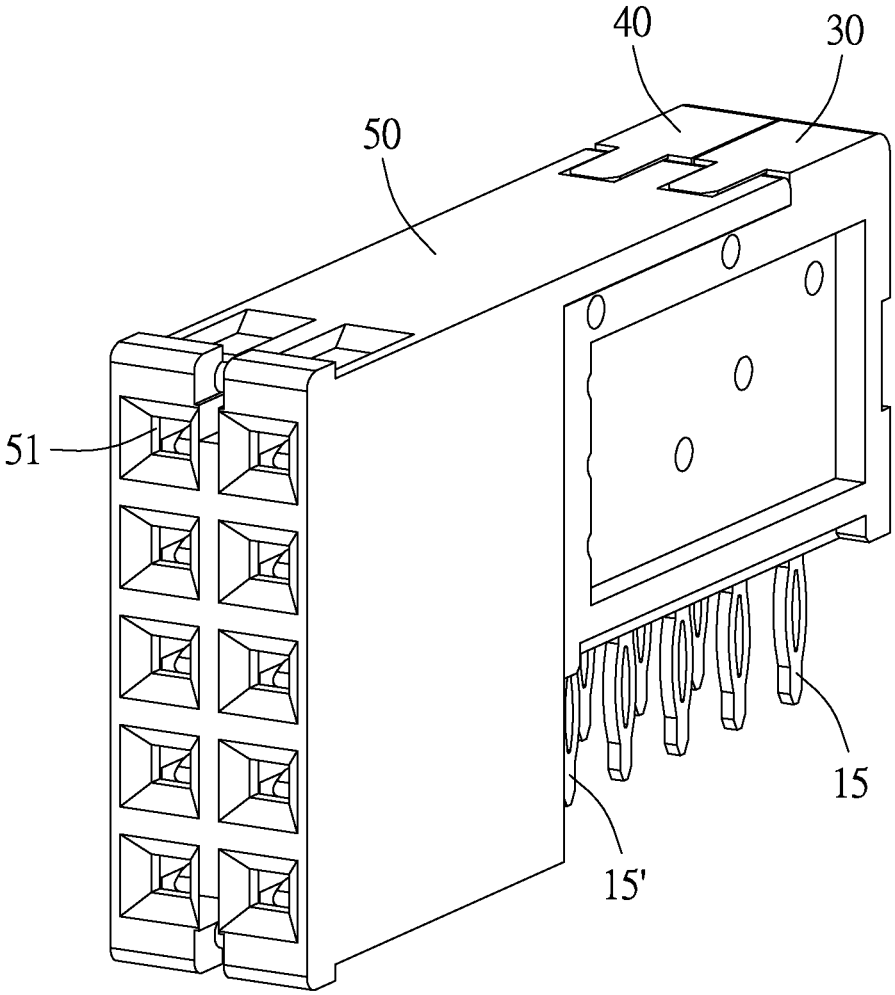
FIG. 6 shows a schematic diagram of an electrical connector of the present disclosure.

Referring to FIG. 2 and FIG. 6, the present disclosure provides an electrical connector including the coupling terminal structure. The electrical connector includes a dielectric housing (label omitted) having the first terminal 10 and the second terminal 20 arranged therein. The dielectric housing fixes the first terminal 10 and the second terminal 20, thereby fixing the first distance D1, the second distance D2 and the third distance D3. The first contact portion 11 and the second contact portion 21 can form an electrical connection interface on any face of the electrical connector.

The dielectric housing can be formed integrally as one body by injection molding, but is not limited thereto. As shown in FIG. 6, the dielectric housing of the present embodiment comprises a first housing 30, a second housing 40 and a third housing 50. The third housing 50 has a plurality of openings 51. The first contact portion 11 and the second contact portion 21 are enclosed by the third housing 50 and align with the openings 51 to form an electrical connection interface (label omitted). The electrical connection interface can be a male plug interface or a female seat interface.

Ideally, the male plug can be a gold finger male plug, pins with tear drop shaped apertures, or other pins. The female seat can be a gold finger female seat, or a female seat with gripping ability. The electrical female seat formed on the side of the third housing 50 of the present embodiment is an ideal example. The demonstrations of the first contact portion 11 and the second contact portion 21 and modifications of are applicable on the third contact portion 15 and the fourth contact portion 25.

Figure 7:
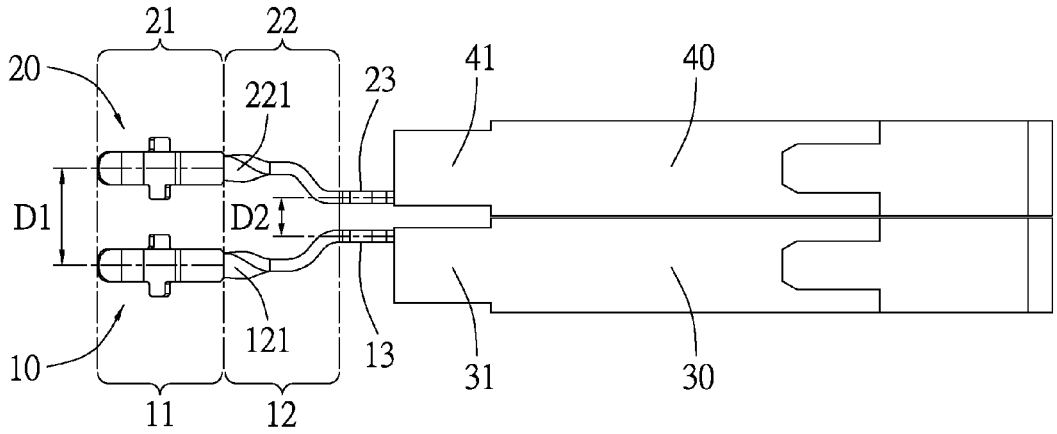
FIG. 7 shows a top view of an electrical connector and part of the terminals within of the present disclosure.
Figure 8:
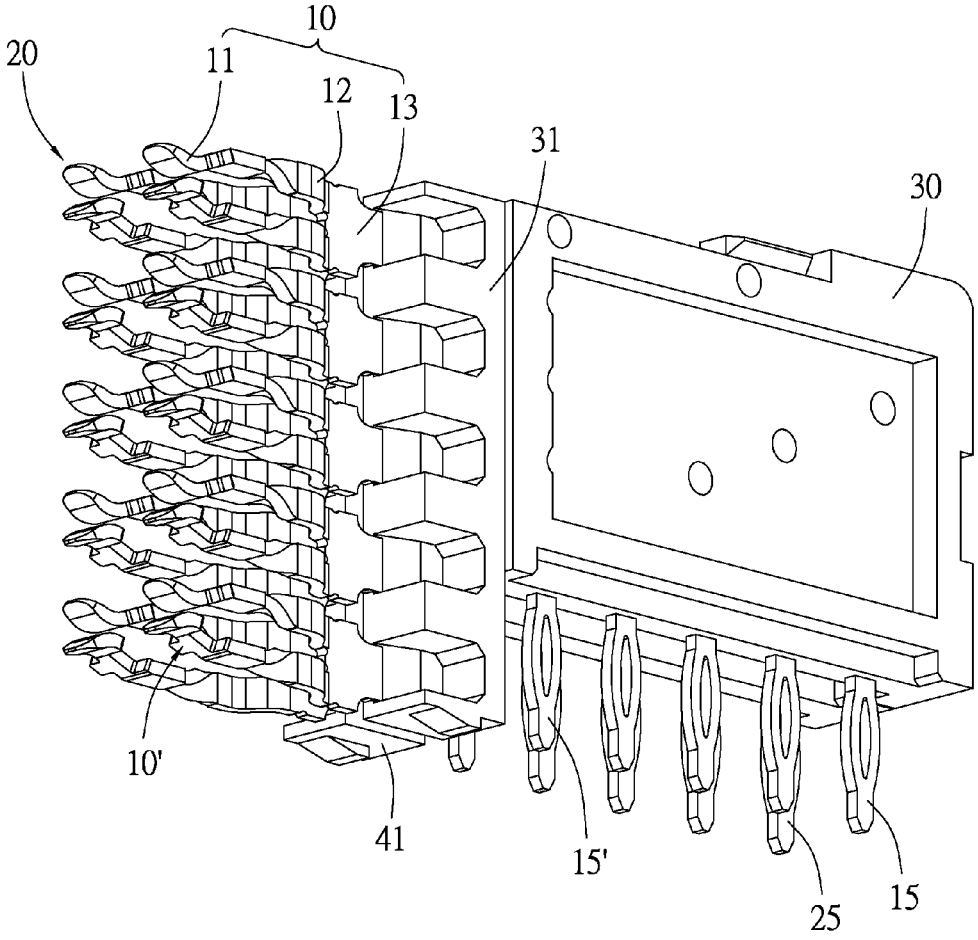
FIG. 8 shows a perspective schematic diagram of an electrical connector and a partial internal view of the terminals of the present disclosure.

As shown in FIG. 7 and FIG. 8, the third housing 50 is removed from the electrical connector, the first housing 30 and the second housing 40 enclose most of the first extension portion 13 and the second extension portion 23, for fixing the first terminal 10 and the second terminal 20, thereby fixing the second distance D2 between the first extension portion 13 and the second extension portion 23. The first housing 30 and the second housing 40 respectively extend to form a first sub housing 31 and a second sub housing 41 proximate to the first neck portion 12 and the second neck portion 22. The first sub housing 31 and the second sub housing 41 are formed slightly longer in the vertical direction than the first housing 30 and the second housing 40, respectively, in order to accommodate and enclose more first terminal 10' below. Moreover, in regards to the third contact portion 15 and the fourth contact portion 25, the first housing 30 and the second housing 40 can also provide fixing functionality for the third distance D3.

In summary, the present disclosure can effectively improve crosstalk between or within terminals, optimizing signal transmission quality. Moreover, through structural arrangement, the present disclosure creates natural electromagnetic coupling effect such that the transmitted signal can be preferably shielded. This method differs from the conventional shielding and grounding method and has the benefit of reducing volume, weight, and production cost.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A coupling terminal structure of an electrical connector, comprising:

a first signal terminal comprising a first contact portion, a first neck portion and a first extension portion; and a second signal terminal comprising a second contact portion corresponding to the first contact portion, a second neck portion corresponding to the first neck portion, and a second extension portion corresponding to the first extension portion, wherein the first signal terminal and the second terminal are in pair arranged side by side without being short-circuited, wherein the first contact portion and the second contact portion are arranged with a first distance there-between, the first extension portion and the second extension portion are arranged with a second distance there-between, the first distance is larger than the second distance, the first extension portion has a wide surface oriented toward a wide surface of the second extension portion, so as to achieve electromagnetic coupling effect to reduce crosstalk interference between the first extension portion and the second extension portion without using a grounded shielding structure during signal transmission.

2. The coupling terminal structure of an electrical connector according to claim 1, wherein the first distance to second distance ratio is between 5.714 and 2.667.

3. The coupling terminal structure of an electrical connector according to claim 1, wherein the first distance is 2 millimeters, and the second distance is 0.55 millimeters.

4. The coupling terminal structure of an electrical connector according to claim 1, wherein the first contact portion and the second contact portion are mutually symmetrical.

5. The coupling terminal structure of an electrical connector according to claim 4, wherein the first contact portion is parallel to the second contact portion.

6. The coupling terminal structure of an electrical connector according to claim 1, wherein the first contact portion includes a first gripping portion and the second contact portion includes a second gripping portion.

7. The coupling terminal structure of an electrical connector according to claim 1, wherein the first extension portion and the second extension portion are mutually symmetrical.

8. The coupling terminal structure of an electrical connector according to claim 1, wherein a third neck portion extends from the first extension portion, a third contact portion extends from the third neck portion, a fourth neck portion corresponding to the third neck portion extends from the second extension portion, and a fourth contact portion corresponding to the third contact portion extends from the second extension portion, wherein the third contact portion and the fourth contact portion are arranged with a third distance there-between, and the third distance is larger than the second distance.

9. The coupling terminal structure of an electrical connector according to claim 1, wherein the first extension portion further comprises a first curved portion and the second extension portion further comprises a second curved portion corresponding to the first curved portion.

10. An electrical connector, comprising:

a coupling terminal structure of the electrical connector and a dielectric housing, wherein the coupling terminal structure of the electrical connector includes:

a first signal terminal comprises a first contact portion, a first neck portion and a first extension portion; and a second signal terminal comprises a second contact portion corresponding to the first contact portion, a second neck portion corresponding to the first neck portion, and a second extension portion corresponding to the first extension portion;

wherein the first signal terminal and the second signal terminal are in pair arranged side by side without being short-circuited, wherein the first contact portion and the second contact portion are arranged with a first distance there-between, the first extension portion and the second extension portion are arranged with a second distance there-between, the first distance is larger than the second distance, the first extension portion has a wide surface oriented toward a wide surface of the second extension portion such that electromagnetic coupling effect is generated to reduce crosstalk interference between the first extension portion and the second extension portion without using a grounded shielding structure during signal transmission; and wherein the terminal network is disposed within the dielectric housing, the dielectric housing fixes the first terminal and the second terminal of the terminal network, thus respectively fixing the first distance and the second distance, and the first contact portion and the second contact portion forms an electric connection interface on any surface of the electrical connector.

11. The electrical connector according to claim 10, wherein the first distance to second distance ratio is between 5.714 and 2.667.

12. The electrical connector according to claim 10, wherein the first distance is 2 millimeters, and the second distance is 0.55 millimeters.

13. The electrical connector according to claim 10, wherein the first contact portion and the second contact portion are mutually symmetrical.

14. The electrical connector according to claim 13, wherein the first contact portion is parallel to the second contact portion.

15. The electrical connector according to claim 10, wherein the first contact portion includes a first gripping portion and the second contact portion includes a second gripping portion.

16. The electrical connector according to claim 10, wherein the first extension portion and the second extension portion are mutually symmetrical.

17. The electrical connector according to claim 10, wherein a third neck portion extends from the first extension portion, a third contact portion extends from the third neck portion, a fourth neck portion corresponding to the third neck portion extends from the second extension portion, and a fourth contact portion corresponding to the third contact portion extends from the second extension portion, wherein the third contact portion and the fourth contact portion are arranged with a third distance there-between, and the third distance is larger than the second distance.

18. The electrical connector according to claim 10, wherein the first extension portion further comprises a first curved portion, and the second extension portion further comprises a second curved portion corresponding to the first curved portion.

* * * * *